US011395054B2

(12) United States Patent
Li et al.

(10) Patent No.: US 11,395,054 B2
(45) Date of Patent: Jul. 19, 2022

(54) SPEAKER MODULE

(71) Applicant: Goertek Inc., Shandong (CN)

(72) Inventors: Zhenjun Li, Shandong (CN); Chengwei Li, Shandong (CN)

(73) Assignee: Goertek Inc., Weifang (CN)

( * ) Notice: Subject to any disclaimer, the term of this patent is extended or adjusted under 35 U.S.C. 154(b) by 0 days.

(21) Appl. No.: 17/294,443

(22) PCT Filed: Dec. 27, 2018

(86) PCT No.: PCT/CN2018/124433
§ 371 (c)(1),
(2) Date: May 17, 2021

(87) PCT Pub. No.: WO2020/098102
PCT Pub. Date: May 22, 2020

(65) Prior Publication Data

US 2021/0409853 A1 Dec. 30, 2021

(30) Foreign Application Priority Data

Nov. 16, 2018 (CN) ..... 201811368270.2

(51) Int. Cl.
*H04R 1/02* (2006.01)

(52) U.S. Cl.
CPC ..... *H04R 1/026* (2013.01); *H04R 1/025* (2013.01)

(58) Field of Classification Search
CPC ..... H04R 1/026; H04R 1/025
USPC ..... 381/386
See application file for complete search history.

(56) References Cited

U.S. PATENT DOCUMENTS 6,731,770 B1 * 5/2004 Vonlanthen ..... H04R 25/556 381/314
6,735,319 B1 * 5/2004 Vonlanthen ..... H04R 25/60 381/322
2007/0104340 A1 * 5/2007 Miller ..... H04R 31/006 381/182

FOREIGN PATENT DOCUMENTS

CN 201657296 U 11/2010
CN 205142515 U 4/2016
CN 1067947589 A 5/2017

* cited by examiner

*Primary Examiner* — Sean H Nguyen
(74) *Attorney, Agent, or Firm* — Baker Botts, LLP

(57) ABSTRACT

The present disclosure provides a speaker module comprising a module middle housing and a module upper housing disposed on the module middle housing, the module upper housing is provided thereon with an injection-molded steel sheet and the module middle housing is provided thereon with an in-built static-electricity-removing structure; the static-electricity-removing structure comprises a conductive plastic member and a metal insert connected with the conductive plastic member, the metal insert being injection molded in the module middle housing; the conductive plastic member is fixed on the module middle housing by means of secondary injection molding, and is configured for conduction with an external device; and the metal insert is connected with the injection-molded steel sheet.

10 Claims, 3 Drawing Sheets

SPEAKER MODULE

CROSS-REFERENCE TO RELATED APPLICATIONS

This application is a National Stage of International Application No. PCT/CN2018/124433, filed on Dec. 27, 2018, which claims priority to Chinese Patent Application No. 201811368270.2, filed on Nov. 16, 2018, both of which are hereby incorporated by reference in their entireties.

TECHNICAL FIELD

The present invention relates to an electro-acoustic conversion apparatus, and more specifically, to a speaker module provided with an in-built static-electricity-removing apparatus.

BACKGROUND

As a result of static electricity, existing speaker modules tends to be damaged in use or suffer from poor performance due to interference. The speaker module generates static electricity for the reasons that: on one hand, the module housing itself will also generate weak current during application or work, and static electricity accumulates continuously and generates a higher voltage when it is released, which easily damages internal components of the module housing and causes product failure; and on the other hand, the other electronic elements or the other internal structures of the electronic device connected to the speaker module may also generate static electricity, which are conducted into the speaker module through contact with the housing. If the static electricity in the module housing cannot be discharged in time, it will cause damage to some fragile electronic parts inside. The approach for removing static electricity in the prior art is essentially to weld a steel sheet outside the speaker housing and then discharge static electricity through the steel sheet, but this approach has the following problems.

Firstly, during external welding of the steel sheet, the housing is likely to be damaged due to high temperature and thus has an impact on appearance thereof.

Secondly, during external welding of the steel sheet, it is not easy to determine welding position and welding angle for the steel sheet. This may cause poor assembly accuracy and has an impact on product yield.

In addition, the approach of externally welding the steel sheet may cause weld marks at a rear end of the steel sheet after welding and assembly, resulting in a poor overall appearance.

Therefore, it is necessary to provide a new technical solution to solve the above technical problems.

SUMMARY

An object of the present invention is to provide a new technical solution for a speaker module.

According to the first aspect of the disclosure, a speaker module is provided, comprising a module middle housing and a module upper housing disposed on the module middle housing, the module upper housing is provided thereon with an injection-molded steel sheet and the module middle housing is provided thereon with an in-built static-electricity-removing structure;

the static-electricity-removing structure comprises a conductive plastic member and a metal insert connected with the conductive plastic member, the metal insert being injection molded in the module middle housing;

the conductive plastic member is fixed on the module middle housing by means of secondary injection molding, and is configured for conduction with an external device; and the metal insert is connected with the injection-molded steel sheet.

Optionally, the conductive plastic member comprises a body and a cantilever, the module middle housing has a part for arranging the metal insert and the part forms a boss, the body is fixed on the boss of the module middle housing by means of secondary injection molding, and the cantilever is connected at one end thereof with an upper surface of the body.

Optionally, the metal insert comprises two parallel short arms and a long arm connecting the two parallel short arms, the long arm being injection molded in the boss; one of the short arms is a first short arm and the other is a second short arm; the second short arm is connected with the conductive plastic member, and the first short arm is connected with the injection-molded steel sheet.

Optionally, the first short arm is exposed from a bottom surface of the boss, and the second short arm is exposed from an upper surface of the boss.

Optionally, the second short arm has an upper surface being flush with an upper surface of the boss.

Optionally, the speaker module further comprises a module lower housing, the module lower housing is arranged on a side of the module middle housing opposite to the module upper housing and is provided with a through hole at a position corresponding to the boss, and the body is fitted to the through hole.

Optionally, the cantilever extends with one end thereof to an outside of a module lower housing.

Optionally, the injection-molded steel sheet is provided with a groove at a position where the injection-molded steel sheet is connected with the metal insert, and the metal insert is clamped in the groove.

Optionally, the module middle housing is provided with a partition plate for separating a front acoustic cavity and a rear acoustic cavity, and the boss is provided on the partition plate.

According to another aspect of the present application, an electronic device is provided, comprising the speaker module described in any one of the above technical solutions.

The beneficial effect of the present invention is that: by mounting the conductive plastic member on the middle housing by means of injection molding, the present invention is able to simplify a product structure, optimize a product appearance, achieve the purpose of removing static electricity, and improve the yield of the product. In the prior art, the use of externally welded steel sheets will affect the accuracy and yield of the product. Therefore, the technical task to be achieved or the technical problem to be solved by the present invention has never been thought of or anticipated by those skilled in the art, so the present invention is a new technical solution.

Other features and advantages of the invention will become clear from the following detailed description of exemplary embodiments of the invention with reference to the drawings.

BRIEF DESCRIPTION OF THE DRAWINGS

The drawings incorporated in the specification and constituting a part of the specification show embodiments of the present invention, and together with the description thereof, serve to explain the principle of the present invention.

DETAILED DESCRIPTION

Figure 1:
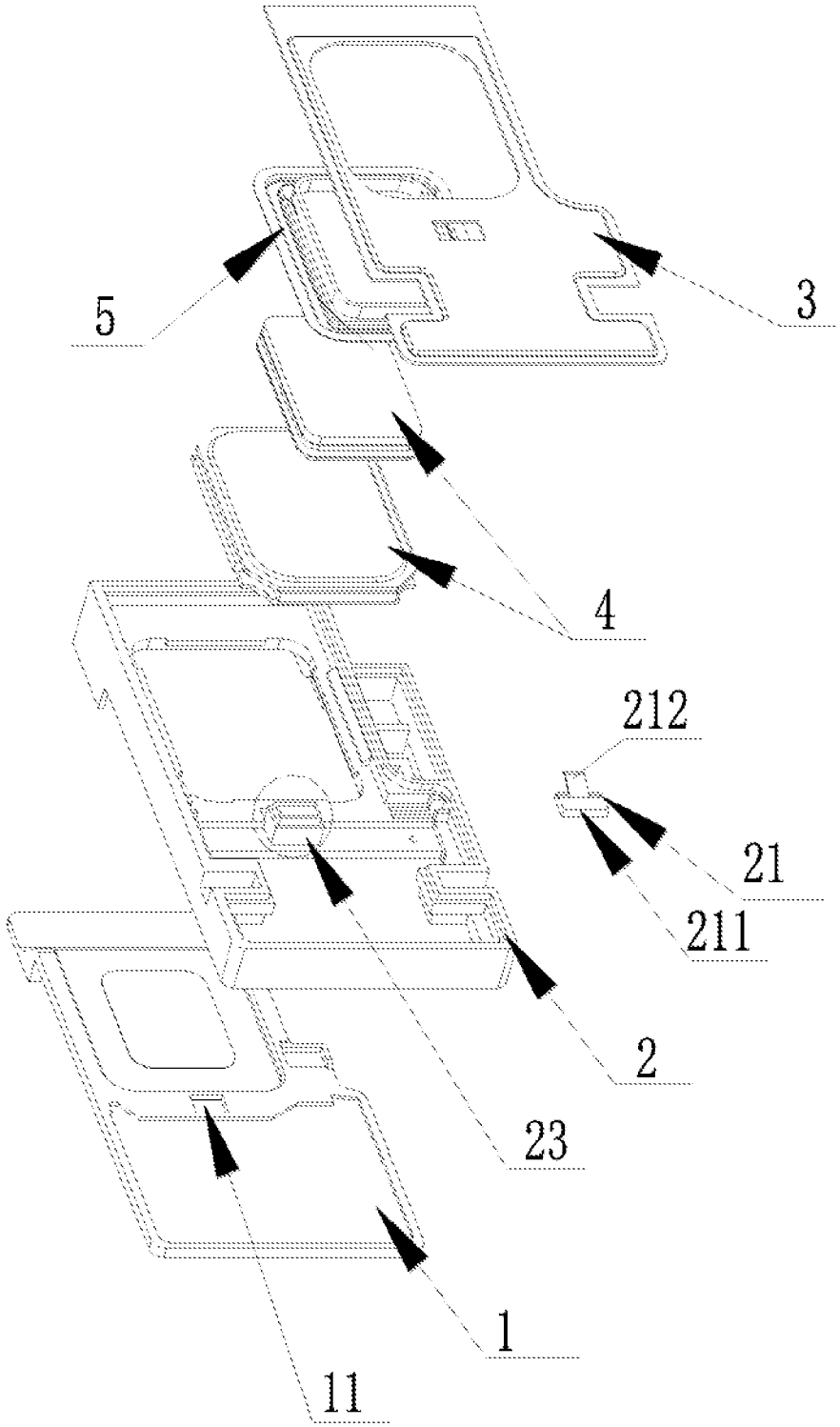
FIG. 1 is an overall schematic structure diagram of an embodiment of a speaker module of the present invention.

Various exemplary embodiments of the invention will now be described in detail with reference to the drawings. It should be needed that: unless specifically stated otherwise, the relative arrangement of components and steps, numerical expressions, and numerical values set forth in these embodiments do not limit the scope of the invention.

The following description of at least one exemplary embodiment is actually merely illustrative, and in no way serves as any limitation on the invention and its application or use.

The technologies, methods, and devices known to those of ordinary skill in the relevant fields may not be discussed in detail, but where appropriate, the technologies, methods, and devices should be regarded as part of the specification.

In all examples shown and discussed herein, any specific values should be interpreted as exemplary only and not as limitations. Therefore, other examples of the exemplary embodiment may have different values.

It should be noted that similar reference numerals and letters indicate similar items in the following figures, so once an item is defined in one figure, it does not need to be further discussed in subsequent figures.

Figure 2:
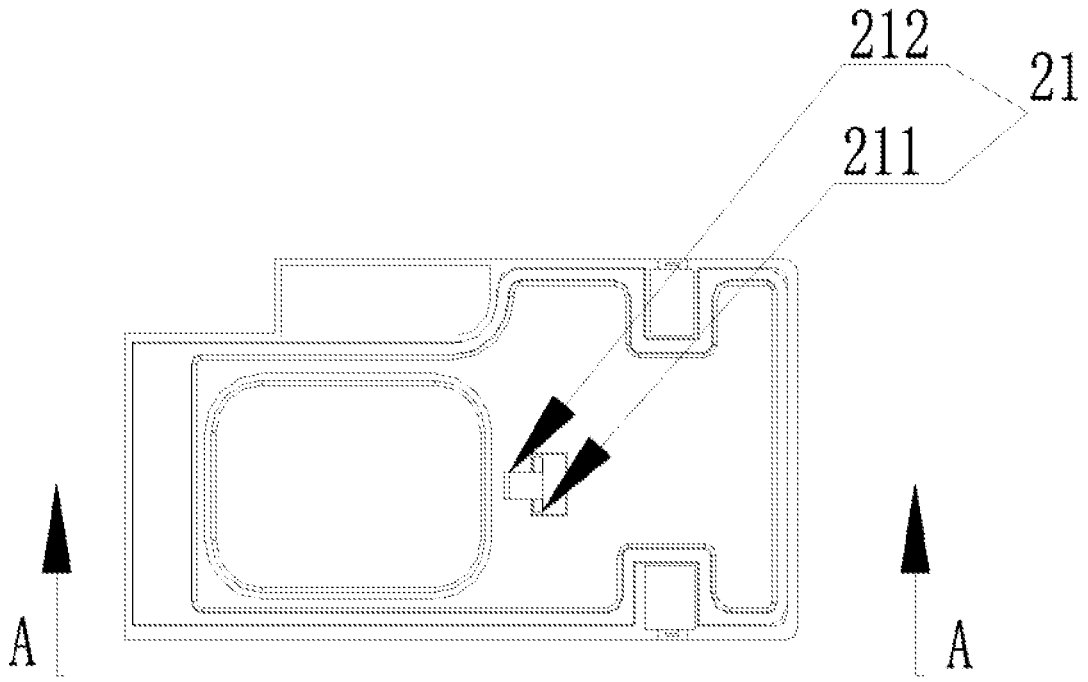
FIG. 2 is a top schematic structure diagram of an embodiment of a speaker module of the present invention.

Referring to FIGS. 1 and 2, a speaker module is provided by an embodiment of the present invention. The speaker module comprises a module middle housing 2 and a module upper housing 1 disposed on the module middle housing 2, wherein the module upper housing 1 is provided thereon with an injection-molded steel sheet and the module middle housing is provided thereon with an in-built static-electricity-removing structure; the static-electricity-removing structure comprises a conductive plastic member and a metal insert connected with the conductive plastic member, and the metal insert is injection molded in the module middle housing; the conductive plastic member is fixed on the module middle housing by means of secondary injection molding, and the conductive plastic member is configured for conduction with an external device; the metal insert is connected with the injection-molded steel sheet.

In the embodiment of the present invention, the module middle housing 2 of the speaker module is made by one injection molding, and the static-electricity-removing structure connects the injection-molded steel sheet to the housing of the device through the metal insert 22 and the conductive plastic member 21. The static electricity on the injection-molded steel sheet are first conducted to the metal insert 22, then conducted from the metal insert 22 to the conductive plastic member, and finally conducted to the housing of the external device through the cantilever 212 of the conductive plastic member 21. When a user holds the device by a hand, the static electricity on the housing are conducted to the ground through the human body.

The conductive plastic member 21 is fixed on the module middle housing 2 by means of secondary injection molding. Compared with the means of welding the steel sheet, the solution of the present application adopts the conductive plastic member 21, which is directly fixed on the middle housing by means of secondary injection molding of the mold during processing, avoiding the process of additional installation for the conductive plastic member. Meanwhile, it can be well controlled in terms of the position and the shape of the conductive plastic member 21, and obtain the produced product with a good precision and a high yield rate.

In an optional embodiment of the present invention, the conductive plastic member 21 comprises a body 211 and a cantilever 212, a part of the module middle housing 2 for arranging the metal insert 22 forms a boss 23, the body 211 is fixed on the boss 23 of the module middle housing 2 by means of secondary injection molding, and an end of the cantilever 212 is connected with an upper surface of the body 211.

Further, the top of the boss 23 is correspondingly provided with a recessed part for cooperating with the arrangement of the body 211 of the conductive plastic member.

After the installation is completed, the cantilever 212 and a surface of the module lower housing 3 are positioned at a set angle. The cantilever 212 is fixed on the body 211 at one end thereof, and is parallel to the surface of the lower housing with a small section of an end at the free end thereof. The parallel structure of this section facilitates the cantilever 212 to fully contact and connect with the external conductive housing after being assembled, and to better discharge the static electricity.

In another optional embodiment of the present invention, the metal insert 22 includes two parallel short arms and a long arm connecting the two short arms, for example, the long arm 223 is perpendicular to the short arms. The long arm is injection molded in the boss 23. One of the short arms is the first short arm 221 and the other is the second short arm 222. The first short arm 221 is exposed from the bottom surface of the boss 23, and the second short arm 222 is exposed from the upper surface of the boss 23. An upper surface of the second short arm 222 is flush with the upper surface of the boss 23.

The metal insert 22 functions to connect the injection-molded steel sheet and the conductive plastic member 21, such that the static electricity on the injection-molded steel sheet is conducted to the conductive plastic member 21, and then is led out from the conductive plastic member 21 to the outer housing.

Figure 3:
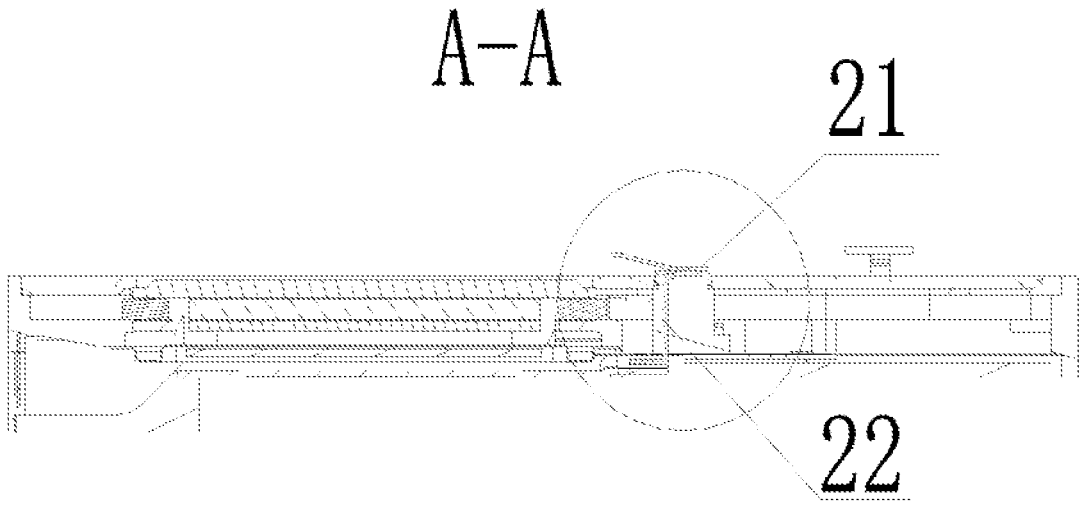
FIG. 3 is an A-A cross-sectional view of an embodiment of a speaker module of the present invention.
Figure 4:
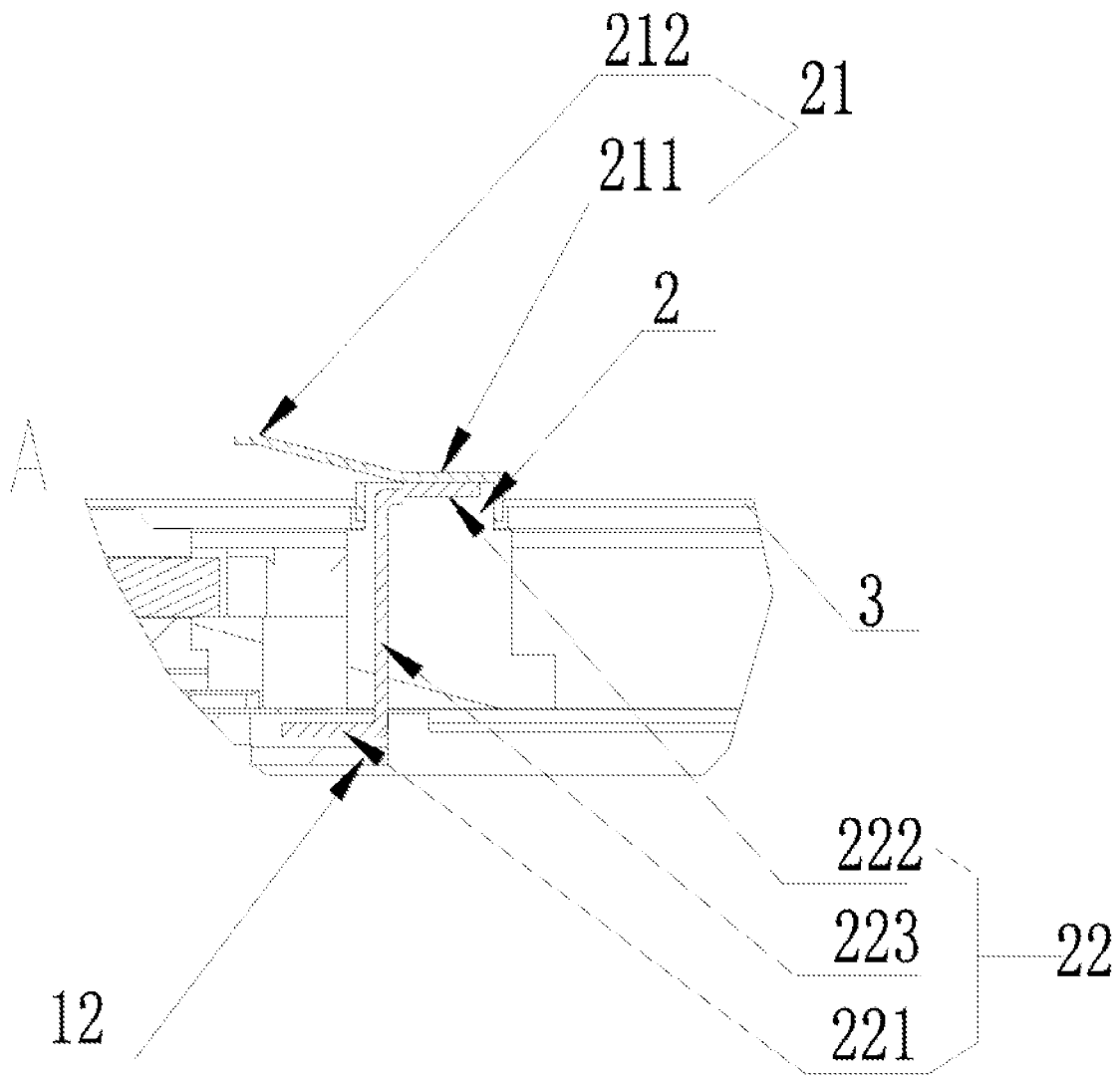
FIG. 4 is a schematic structural diagram of the static-electricity-removing structure of an embodiment of a speaker module of the present invention.

Further, referring to FIGS. 3 and 4, the first short arm 221 of the metal insert is connected with the injection-molded steel sheet 12. For example, the first short arm 221 is connected to the injection-molded steel sheet 12 by welding, conductive adhesive bonding or the like. The second short arm 222 is connected to the body of the conductive plastic member 21. For example, the conductive plastic member 21 is directly connected with the second short arm 222 during the injection molding.

The metal insert 22 is fixed inside the boss 23 by means of injection molding, the vertically arranged long arm 223 is embedded in the boss 23, and the two short arms extend from the upper and lower surfaces of the boss and are respectively in contact with the injection-molded steel sheet 12 and the conductive plastic member 21.

In addition, the upper surface of the second short arm 222 is flush with the upper surface of the boss 23 or slightly protrudes from the upper surface of the boss 23, which may achieve the connection with the conductive plastic member 21.

When the upper surface of the second short arm 222 is flush with the upper surface of the boss 23, it saves space, which is beneficial to reduce the thickness of the overall device and to make the product thinner and lighter.

In another embodiment of the present invention, the speaker module further comprises a module lower housing, wherein the module lower housing 3 is arranged on a side of the module middle housing 2 opposite to the module upper housing 1, and is provided with a through hole at a position corresponding to the boss 23. The body 211 of the conductive plastic member 21 is fitted and installed in the through hole.

The through hole has a size compatible with the size of the boss 23, so that the boss is just clamped at the through hole during installation for fixing.

In addition, the upper part of the boss 23 exposes the surface of the module lower housing 3. The cantilever 211 of the conductive plastic member 21 is located outside the module lower housing 3, and is used to discharge the static electricity after being connected to the housing of the external device. That is, the module lower housing 3 is installed on the module middle housing 2, the upper part of the boss 23 extends out of the through hole, the upper surface extends beyond the upper surface of the module lower housing 3 and the cantilever 212 of the conductive plastic member 21 also extends beyond the through hole, which facilitate the connection with the outer housing.

In another optional embodiment of the present invention, a groove 11 is provided at a position where the injection-molded steel sheet 12 of the module upper housing 1 is connected with the metal insert 22, and the metal insert is clamped in the groove 11.

The groove 11, on the one hand, may assist in installation and fixation, and on the other hand, may play a role of limiting and meanwhile ensure the closer contact between the metal insert and the injection-molded steel sheet.

In an optional embodiment of the present invention, the speaker module further comprises a diaphragm assembly 4 and a magnetic circuit assembly 5 arranged between the module lower housing 3 and the module middle housing 2.

Although some specific embodiments of the present invention have been described in detail through examples, those skilled in the art should understand that the above examples are only for illustration and not for limiting the scope of the present invention. It should be understood by a person skilled in the art that the above embodiments can be modified without departing from the scope and spirit of the present invention. The scope of the present invention is defined by the attached claims.

The invention claimed is:

1. A speaker module, comprising a module middle housing and a module upper housing disposed on the module middle housing, the module upper housing being provided with an injection-molded steel sheet and the module middle housing being provided with an in-built static-electricity-removing structure; wherein the static-electricity-removing structure comprises a conductive plastic member and a metal insert connected with the conductive plastic member, the metal insert being injection molded in the module middle housing;

the conductive plastic member is fixed on the module middle housing by a secondary injection molding, and is configured for conduction with an external device; and the metal insert is connected with the injection-molded steel sheet.

2. The speaker module of claim 1, wherein the conductive plastic member comprises a body and a cantilever, the module middle housing has a part for arranging the metal insert and the part forms a boss, the body is fixed on the boss of the module middle housing by a secondary injection molding, and the cantilever is connected to an end thereof with an upper surface of the body.

3. The speaker module of claim 2, wherein the metal insert comprises a first short arm, a second short arm parallel thereto and a long arm connecting the first and the second short arms, the long arm being injection molded in the boss; wherein the second short arm is connected with the conductive plastic member, and the first short arm is connected with the injection-molded steel sheet.

4. The speaker module of claim 3, wherein the first short arm is exposed from a bottom surface of the boss, and the second short arm is exposed from an upper surface of the boss.

5. The speaker module of claim 4, wherein the second short arm has an upper surface being flush with an upper surface of the boss.

6. The speaker module of claim 2, further comprising a module lower housing, the module lower housing is arranged on a side of the module middle housing opposite to the module upper housing and is provided with a through hole at a position corresponding to the boss, and the body is fitted to the through hole.

7. The speaker module of claim 2, wherein the cantilever extends with an end thereof to an outside of a module lower housing.

8. The speaker module of claim 2, wherein the module middle housing is provided with a partition plate for separating a front acoustic cavity and a rear acoustic cavity, and the boss is provided on the partition plate.

9. The speaker module of claim 1, wherein the injection-molded steel sheet is provided with a groove at a position where the injection-molded steel sheet is connected with the metal insert, and the metal insert is clamped in the groove.

10. An electronic device, comprising the speaker module of claim 1.

* * * * *